United States Patent [19]

Rizzuto

[11] 4,009,367

[45] Feb. 22, 1977

[54] STEAM-PRODUCING CURLING IRON

[75] Inventor: L. P. Rizzuto, Brooklyn, N.Y.

[73] Assignee: Conair Corporation, Edison, N.J.

[22] Filed: Jan. 29, 1975

[21] Appl. No.: 545,053

[52] U.S. Cl. ..... 219/222; 132/9; 132/32 R; 132/37 R; 219/225; 219/274; 219/533

[51] Int. Cl.[2] ..... H05B 1/00; A45D 1/04; A45D 2/36; A45D 7/02

[58] Field of Search ..... 219/222–225, 219/271–276, 230, 533; 132/7, 9, 31 R, 32 R, 33 R, 37 R, 112, 117, 118, 36 R, 41 C; 128/186; 239/132–136, 49, 50; 38/69, 71; 21/117–120

[56] References Cited

UNITED STATES PATENTS

| | | | |
|---|---|---|---|
| 1,400,784 | 12/1921 | Archer | 219/230 X |
| 1,510,359 | 9/1924 | VanGale | 132/41 C |
| 1,904,043 | 4/1933 | Frank et al. | 132/37 R |
| 2,065,874 | 12/1936 | Salvio | 132/41 C |
| 2,228,505 | 1/1941 | Carter et al. | 219/274 X |
| 2,244,180 | 6/1941 | Williams et al. | 219/273 |
| 2,491,845 | 12/1949 | Beer | 219/222 X |
| 2,898,649 | 8/1959 | Murray | 219/274 X |
| 2,935,070 | 5/1960 | Auz | 219/222 X |
| 3,220,421 | 11/1965 | Van Droogenbroek et al. | 219/222 UX |
| 3,610,259 | 10/1971 | Brown | 219/222 UX |
| 3,835,292 | 9/1974 | Walter et al. | 219/222 |
| 3,934,114 | 1/1976 | Godel et al. | 219/222 |

*Primary Examiner*—A. Bartis
*Attorney, Agent, or Firm*—Alan H. Levine

[57] ABSTRACT

A steam-producing curling iron includes a tubular barrel having a handle at one end and a liquid reservoir at the other end. An electrically-heated heating member is axially slidable within the barrel into and out of engagement with a stationary wick communicating with the reservoir. The heating member is guided by elongated depressions formed in the barrel surface and is spring biased to be normally spaced from the wick. A sliding seal is provided between the heating member and barrel whereby a steam chamber is defined between the seal and the wick. An actuating lever mounted on the handle is connected by a linkage to the heating member rearwardly of the seal for selectively moving the heating member into contact with the wick to generate steam in the steam chamber for discharge through holes in the barrel.

17 Claims, 6 Drawing Figures

STEAM-PRODUCING CURLING IRON

This invention relates to curling irons for curling hair, and more particularly to curling irons of the type which apply steam to the hair wound upon the curling iron.

Steam-producing curling irons are, in general, not new. One type of such curling iron is illustrated and described in U.S. Pat. No. 3,835,292. That curling iron comprises a tubular barrel around which hair is wound, the barrel having a handle at one end and a liquid reservoir at the other end. Fixed within the barrel is a heating element, and projecting toward the heating element from the reservoir is a wick. The reservoir and wick are slidable axially with respect to the barrel, so that the reservoir can be moved toward the heating element to bring the wick and heating element into contact and thereby produce steam. Thus, it will be appreciated that when the curling iron is used two hands must be employed, one hand grasping the handle of the curling iron, and the other manipulating the reservoir. This two hand operation is not only inconvenient, but can be rather difficult particularly when hair at the back of the head is being curled.

It is an object of the present invention to improve upon this type of curling iron by providing a steam-producing curling iron which can be operated with one hand.

More specifically, it is an object of the present invention to provide such a curling iron in which production of steam can be controlled by one finger of the hand which grasps the handle of the curling iron.

Additional objects and features of the invention will be apparent from the following description, in which reference is made to the accompanying drawings.

Figure 1:
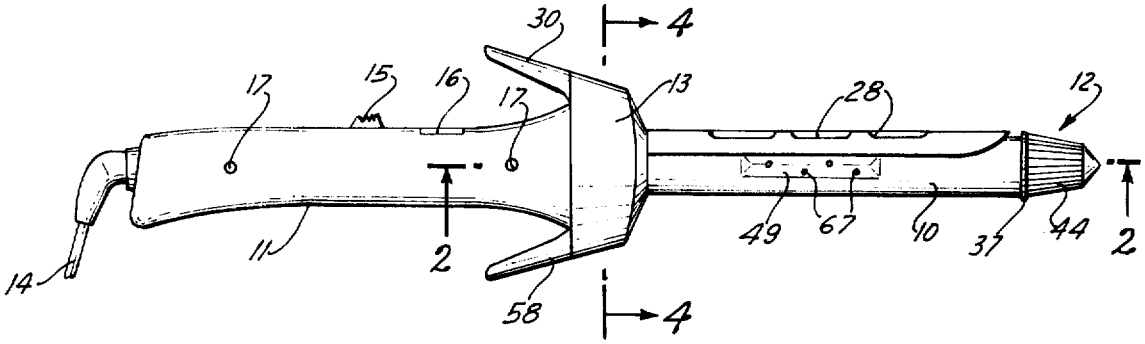
FIG. 1 is a side elevational view of a steam-producing curling iron according to the present invention.

The curling iron chosen to illustrate the present invention comprises a cylindrical tubular barrel 10 having a handle 11 at one end and a reservoir 12 at the other end. At the end of handle 11 which joins barrel 10, the handle is formed with an enlarged collar portion 13, and extending from the opposite end of handle 11 is an electric power cord 14. The free end of power cord 14 is provided with the usual plug (not shown) for insertion into an electrical receptacle to provide electric power to the curling iron. On handle 11 is a switch 15, for energizing and deenergizing a heating member within barrel 10, and a pilot light 16 for indicating whether or not the switch is turned on or off. Handle 11 and collar 13 are made in two parts, preferably of molded plastic, the parts being joined along a longitudinal line of separation and held together by screws 17.

Figure 4:
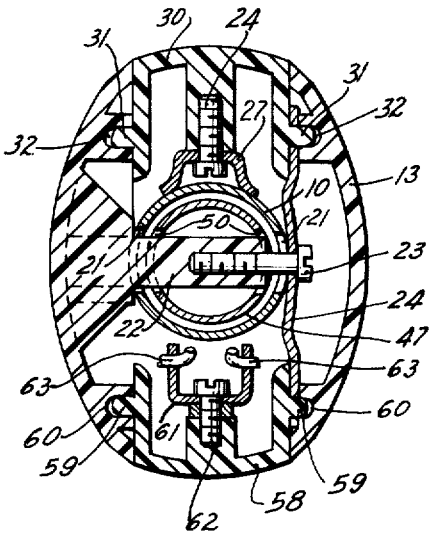
FIG. 4 is a transverse cross-sectional view, on an enlarged scale, taken along line 4—4 of FIG. 1.
Figure 2:
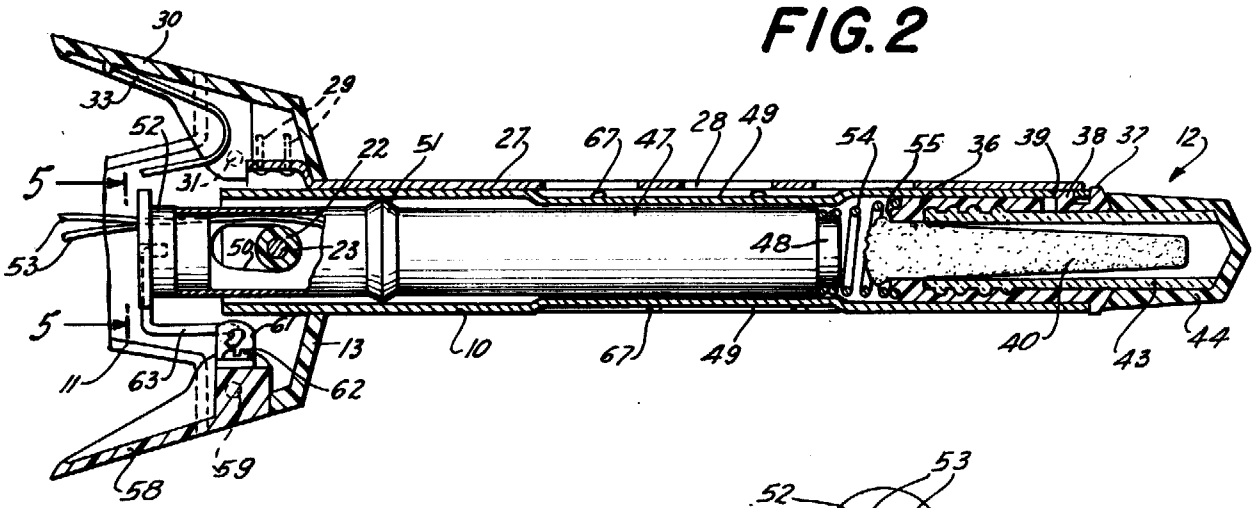
FIG. 2 is a fragmentary, longitudinal cross-sectional view, on an enlarged scale, taken along line 2—2 of FIG. 1.

As best seen in FIGS. 2 and 4, one end of barrel 10, which may be formed of thin metal, fits into an opening in collar 13. In order to prevent barrel 10 from moving axially away from handle 11, the barrel is provided with two diametrically opposite circular holes 21, and a post 22 molded integrally with collar 13 passes through one of the holes 21. A screw 23, passing through a plate 24 fixed to collar 13, passes through the other hole 21 in barrel 10 and is threaded into post 22.

Extending along most of the length of barrel 10 is a clamp 27, which may be formed of thin metal, having an arcuate transverse shape so that it conforms to the external contour of barrel 10. Clamp 27 is formed with elongated openings 28 which permit the flow of steam through the clamp. One end of clamp 27 is fixed by screws 29 to a lever 30 pivotally mounted in collar 13 about an axis perpendicular to the longitudinal axis of barrel 10. As best seen in FIG. 4, lever 30 is formed with two outwardly projecting coaxial pins 31 snugly but rotatably accommodated within bores 32 formed in the interior of collar 13. Pins 31, of course, define the pivot axis of lever 30. When lever 30 is depressed, clamp 27 pivots away from barrel 10 so that the end of a lock of hair to be curled can be placed between the barrel and clamp. Lever 30 is then released, and a spring 33 returns clamp 27 toward barrel 10. As a result, the end of the lock of hair is gripped between clamp 27 and the barrel, and the remainder of the lock of hair can then be wound around the barrel and clamp simply by rotating the curling iron around the longitudinal axis of barrel 10.

Figure 3:
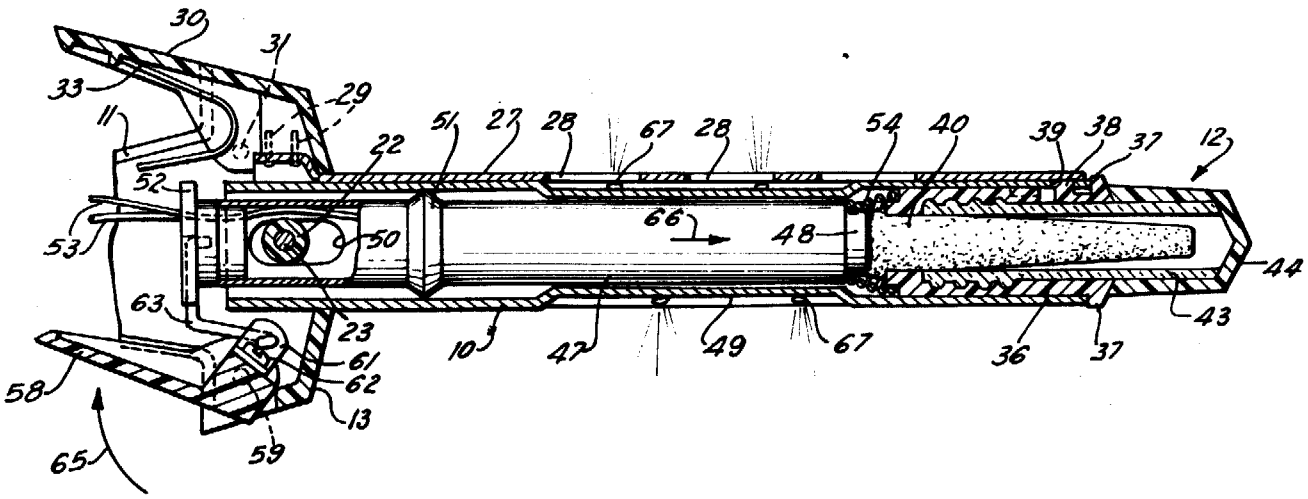
FIG. 3 is a view similar to FIG. 2 showing the parts in condition for producing steam.

Fixed within the end of barrel 10, opposite handle 11, is a sleeve 36 (see FIGS. 2 and 3). At one end, sleeve 36 is formed with a shoulder 37 of larger diameter than barrel 10. When the parts are assembled, shoulder 37 engages the end of barrel 10 thereby defining the assembled relationship between two parts. Spaced inwardly from shoulder 37, sleeve 36 is formed with a detent 38 which snaps into a rectangular hole 39 in barrel 10 when the sleeve and barrel are assembled. The cooperation between detent 38 and hole 39 prevents sleeve 36 from moving out of barrel 10. Thus, the cooperation of shoulder 37 and detent 38 with barrel 10 maintains sleeve 36 stationary with respect to barrel 10.

The internal bore of sleeve 36 is reduced in diameter at its innermost end, and at this point the sleeve grips a wick 40 of absorbent material. The inner end of wick 40 projects past sleeve 36 and is exposed within the interior of barrel 10. The major portion of wick 40 extends axially through and beyond the bore within sleeve 36. Adjacent to its innermost end, the bore within sleeve 36 is formed with an internal screw thread.

Reservoir 12 comprises a tube 43 having an external screw thread at its inner end adapted to cooperate with the screw thread in sleeve 36. At its outer end, tube 43 has a cap 44 fixed to it in a permanent manner. To fill reservoir 12, cap 40 is rotated so as to unscrew tube 43 from sleeve 36, thereby permitting the cap and tube to be removed from the sleeve. Tube 43 is then filled with a suitable liquid, such as water, and the tube is inserted and screwed into sleeve 36 until the parts reach the position shown in FIGS. 2 and 3. Wick 40 absorbs the liquid and carries it to the innermost end of the wick exposed within barrel 10.

Axially slidable within barrel 10 is a heating member comprising a tube 47 (FIGS. 2–4) carrying within it an electrically-heated element 48. Heater element 48 projects beyond the end of tube 47 toward wick 40. Movement of tube 47 within barrel 10 is guided by four elongated depressions 49 formed in barrel 10. Movement is also guided by two diametrically opposed elongated slots 50 in tube 47 which slidably accommodate post 22.

Figure 5:
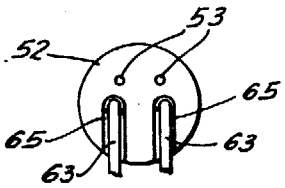
FIG. 5 is a fragmentary transverse cross-sectional view taken along line 5—5 of FIG. 2.

Surrounding tube 47 is a sealing ring 51 which moves with tube 47 and has a sliding engagement with the inner surface of barrel 10. Sealing ring 51 engages barrel 10 along a continuous line and hence prevents liquid within the barrel from flowing past the sealing ring into handle 11 where it might interfere with electrical components housing within the handle. A plug 52 fits frictionally within the end of the tube 47 closest to handle 11, and electrical wires 53 pass through two holes in plug 52 (see also FIG. 5) and into tube 47 to carry electric current to heater element 48. A compression coil spring 54 is arranged between sleeve 36 and heating member 47, 48, one end of spring 54 surrounding a boss 55 projecting from sleeve 36, and the other end of spring 54 surrounding heater element 48 and bearing against the end of tube 47.

Handle 11 carries an actuator means in the form of a lever 58 pivoted within collar 13 about an axis perpendicular to the longitudinal axis of barrel 10. As best seen in FIG. 4, lever 58 is formed with two outwardly projecting coaxial pins 59 snugly but rotatably accommodated within bores 60 formed in the interior of collar 13. The axis of pins 59 defines the pivot axis of lever 58. A U-shaped bracket 61 (FIGS. 2–4) is fixed by screw 62 to the end of lever 58 located within collar 13. A link in the form of a bent wire 63 pivotally connects each arm of bracket 61 to plug 52. More specifically, one end of each link 63 fits pivotally through a hole in its respective arm of bracket 61, and the other end of link 53 fits into a hole 64 in cap 52. The straight portion of each link 63 adjacent to the latter end is accommodated within a groove 65 in cap 52.

FIG. 2 illustrates the position of the parts when no steam is desired. Lever 58 is not actuated, and hence spring 54 maintains tube 47 in its retracted position defined by engagement of one end of each slot 50 with post 22. In this condition, heater element 48 is spaced from wick 40. When steam is desired, lever 58 is depressed in the direction of arrow 65 to the position shown in FIG. 3. This movement is transmitted by links 63 to cap 52 in the end of tube 47, thereby moving tube 47 in the direction of arrow 66 against the force of spring 54. This movement brings heater element 48 into engagement with wick 40. As a result of this engagement, the liquid carried by wick 40 is immediately converted into steam within barrel 10. The steam flows out of barrel 10 through holes 67 formed in the barrel in the region of depressions 49. The steam is of course applied to hair wound around barrel 10 and clamp 27. When production of steam is to be terminated, lever 58 is simply released allowing spring 54 to return tube 47 from its advanced position shown in FIG. 3 to its retracted position shown in FIG. 2.

It will be appreciated, particularly from an inspection of FIG. 1, that lever 58 can readily be depressed by the thumb or forefinger of a hand grasping handle 11. Therefore, the steam-producing curling iron of the present invention can easily be operated with one hand.

Figure 6:
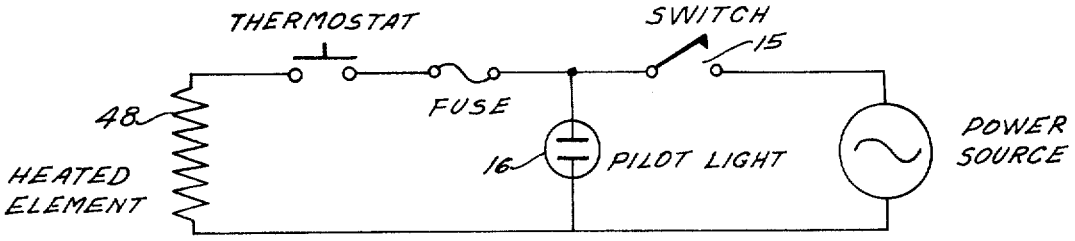
FIG. 6 is a schematic diagram of the electric circuit in the curling iron.

FIG. 6 illustrates the electric circuitry of the curling iron. It will be seen that heater element 48 and pilot light 16 are arranged in parallel across the electric power source, and that switch 15 controls flow of power to both the heater element and pilot light. Furthermore, arranged within the heater element circuit is a thermostat for opening the circuit should the temperature of the element rise above a predetermined value, and a fuse for opening the heater element circuit in the event of a malfunction.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A steam-producing curling iron comprising:

a. a tubular barrel of appropriate size and shape for having hair wound around it, said barrel having holes along at least a portion of its length, said holes extending through the wall of said barrel, b. an elongated heating member axially slidable within said barrel between an advanced position and a retracted position, said barrel having a plurality of elongated depressions for guiding the movement of said heating member, c. a handle at one end of said barrel, d. a liquid-containing means at the other end of said barrel, said liquid-containing means including a reservoir and a liquid-transmitting means communicating with said reservoir and exposed within said barrel in a region which communicates with said holes, said liquid-transmitting means being in the path of movement of said heating member and arranged to be contacted by said heating member, to produce steam, when said heating member is in its advanced position, e. a seal between said heating member and said barrel, said seal permitting sliding movement between said heating member and barrel, and a steam chamber being defined between said seal and said liquid-transmitting means, said holes permitting escape of steam from said chamber, and f. actuator means carried by said handle and operatively associated with said heating member for sliding said heating member between its advanced and retracted positions, said actuator means being movable with respect to said handle and being located so that it may be operated by the same hand of the user which grasps said handle, whereby when hair is wound around said barrel and said actuator means is manipulated to slide said heating member to its advanced position, steam produced within said barrel flows out of said barrel through said holes and is applied to the wound hair.

2. A steam-producing curling iron as defined in claim 1 including resilient means, associated with one of said heating member and said actuator means, constantly urging said heating member toward its retracted position.

3. A steam-producing curling iron as defined in claim 2 including an abutment fixed within said barrel, and wherein said resilient means is a spring arranged between said abutment means and said heating member.

4. A steam-producing curling iron as defined in claim 1 wherein said heating member is electrically heated, and including means within said handle for transmitting electric current to said heating member.

5. A steam-producing curling iron as defined in claim 4 wherein said seal surrounds said heating member, said seal engaging the inner surface of said barrel along a continuous line so as to prevent liquid from flowing from said barrel into said handle, said holes in said barrel being between said seal and said liquid-transmitting means.

6. A steam-producing curling iron as defined in claim 1 wherein said liquid-transmitting means is a wick of absorbent material within said reservoir, said wick being fixed with respect to said barrel.

7. A steam-producing curling iron as defined in claim 1 wherein said actuator means includes a lever pivotally mounted about an axis fixed with respect to said handle, and link means between said lever and said heating member for transmitting movement of said lever to said heating member.

8. A steam-producing curling iron as defined in claim 7 including a second lever pivotally mounted about an axis fixed with respect to said handle, said second lever being located diametrically opposite said actuator means lever, and an elongated clamp fixed to said second lever and extending longitudinally along the exterior of said barrel, whereby the end of a lock of hair to be wound around said barrel can be gripped between said clamp and said barrel.

9. A steam-producing curling iron as defined in claim 1 wherein said holes in said barrel are located within at least one of said elongated depressions.

10. A steam-producing curling iron comprising:

a. a tubular barrel of appropriate size and shape for having hair wound around it, said barrel having holes along at least a portion of its length, said holes extending through the wall of said barrel, b. a heating member axially slidable within said barrel between an advanced position and a retracted position, c. means associated with said barrel for guiding the movement of said heating member, d. a handle at one end of said barrel, e. a liquid-containing means at the other end of said barrel, said liquid-containing means including a reservoir and a liquid-transmitting means communicating with said reservoir and exposed within said barrel in a region which communicates with said holes, said liquid-transmitting means being in the path of movement of said heating member and arranged to be contacted by said heating member, to produce steam, when said heating member is in its advanced position, f. a seal between said heating member and said barrel, said seal permitting sliding movement between said heating member and barrel, and a steam chamber being defined between said seal and said liquid-transmitting means, said holes permitting escape of steam from said chamber, and g. actuator means carried by said handle and operatively associated with said heating member for sliding said heating member between its advanced and retracted positions, said actuator means being movable with respect to said handle and being located so that it may be operated by the same hand of the user which grasps said handle, said actuator means including a finger-operable member exposed on the exterior of said handle, and link means between said finger-operable member and said heating member for transmitting movement of said finger-operable member to said heating member, said link means being connected to said heating member on the side of said seal opposite said steam chamber, whereby when hair is wound around said barrel and said actuator means is manipulated to slide said heating member to its advanced position, steam produced within said barrel flows out of said barrel through said holes and is applied to the wound hair.

11. A steam-producing curling iron as defined in claim 10 including resilient means, associated with one of said heating member and said actuator means, constantly urging said heating member toward its retracted position.

12. A steam-producing curling iron as defined in claim 11 including an abutment fixed within said barrel, and wherein said resilient means is a spring arranged between said abutment means and said heating member.

13. A steam-producing curling iron as defined in claim 10 wherein said heating member is electrically heated, and including means within said handle for transmitting electric current to said heating member.

14. A steam-producing curling iron as defined in claim 13 wherein said seal surrounds said heating member, said seal engaging the inner surface of said barrel along a continuous line so as to prevent liquid from flowing from said barrel into said handle, said holes in said barrel being between said seal and said liquid transmitting means.

15. A steam-producing curling iron as defined in claim 10 wherein said liquid-transmitting means is a wick of absorbent material within said reservoir, said wick being fixed with respect to said barrel.

16. A steam-producing curling iron as defined in claim 10 wherein said finger-operable member includes a lever pivotally mounted about an axis fixed with respect to said handle.

17. A steam-producing curling iron as defined in claim 16 including a second lever pivotally mounted about an axis fixed with respect to said handle, said second lever being located diametrically opposite said actuator means lever, and an elongated clamp fixed to said second lever and extending longitudinally along the exterior of said barrel, whereby the end of a lock of hair to be wound around said barrel can be gripped between said clamp and said barrel.

* * * * *